United States Patent [19]

Eckhardt

[11] Patent Number: 4,489,252

[45] Date of Patent: Dec. 18, 1984

[54] ELECTRIC LAMP

[75] Inventor: Fritz Eckhardt, Dettingen, Fed. Rep. of Germany

[73] Assignee: Patent-Treuhand-Gesellschaft fur elektrische Gluhlampen mbH, Munich, Fed. Rep. of Germany

[21] Appl. No.: 416,633

[22] Filed: Sep. 10, 1982

[30] Foreign Application Priority Data

Oct. 23, 1981 [DE] Fed. Rep. of Germany ... 8131006[U]

[51] Int. Cl.[3] ..... H01J 5/48; H01J 5/50; H01J 5/46

[52] U.S. Cl. ..... 313/318; 313/331; 313/634

[58] Field of Search ..... 313/318, 634, 331

[56] References Cited

U.S. PATENT DOCUMENTS 3,573,534 4/1971 Leighton ..... 313/318
4,371,807 2/1983 Eckhardt ..... 313/318
4,396,860 8/1983 Hellwig et al. ..... 313/318

FOREIGN PATENT DOCUMENTS 54-129770 10/1979 Japan ..... 313/318
2029093 3/1980 United Kingdom ..... 313/318

*Primary Examiner*—David K. Moore
*Assistant Examiner*—Vincent DeLuca
*Attorney, Agent, or Firm*—Frishauf, Holtz, Goodman & Woodward

[57] ABSTRACT

A metal sleeve 5 grips the press stem 4 of lamp bulb 1. The metal sleeve, which is set in the metal base structure 10, has a groove 13 at its outer surface. One end 3*a* of a current lead-in wire 3 is placed in the groove, contacting the metal base shell 10 which thereby can be made a side contact for the lamp. The placement of the wire end 3*a* in the groove of the metal sleeve 5 avoids interference with adjustment and focussing of the lamp in the base shell.

14 Claims, 3 Drawing Figures

ELECTRIC LAMP

The present invention relates to an electric lamp, and particularly to a lamp whose base socket structure serves to provide proper positioning and focusing for the lamp.

BACKGROUND

High brightness, halogen cycle incandescent lamps are well known in the art. Due to the intense heat which such lamps generate, their glass housing is generally made of a high-temperature, refractory material, such as quartz. Due to the difficulty of making an air-tight quartz-to-metal seal, the lead-in conductors are generally passed through a flat-shaped stem at the bottom and top of the lamp. Proper positioning of the lamp is then provided by a housing structure into which the stems are fitted.

THE INVENTION

It is an object of the present invention to insure the proper positioning adjustment and focusing of a lamp, especially a halogen incandescent lamp, having a single press stem at the bottom of the lamp, with the base shell structure serving also to provide a side contact for the lamp.

Briefly, the lamp is provided with a metal sleeve which grips the press stem of the lamp and is itself fitted into the base shell and rigidly attached thereto. The metal sleeve is provided with a groove at the outer rim of the sleeve, which holds a lead-in wire in electrical contact with the metallic base shell and, at its other end, the lead-in wire passes through the press stem to contact the lamp filament.

DRAWINGS

Figure 1:
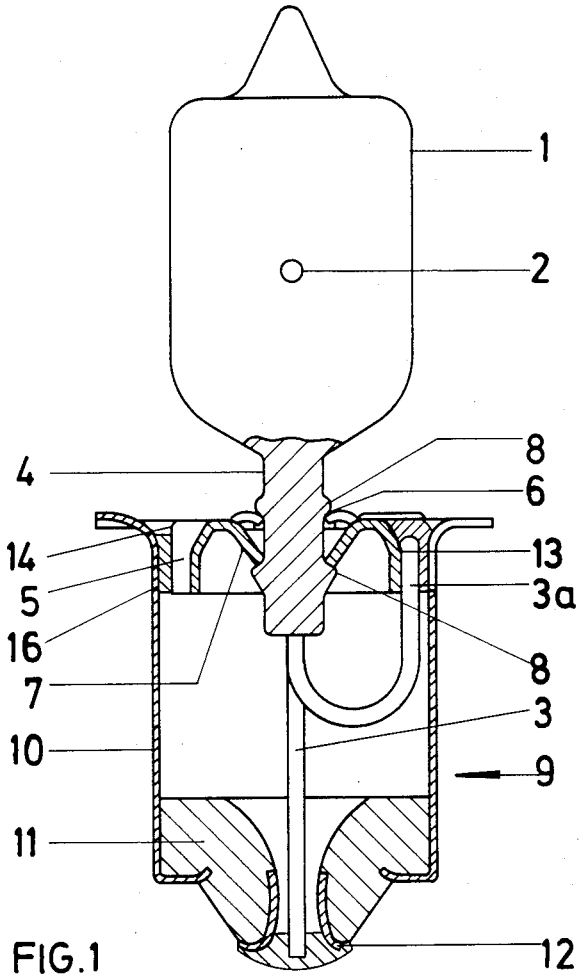
FIG. 1 is an axial section of an electric lamp, with a base shell structure providing the side electric contact.
Figure 3:
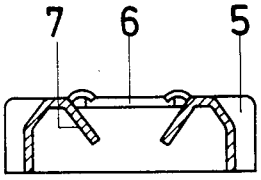
FIG. 3 is a sectional view of the metal cap.
Figure 2:
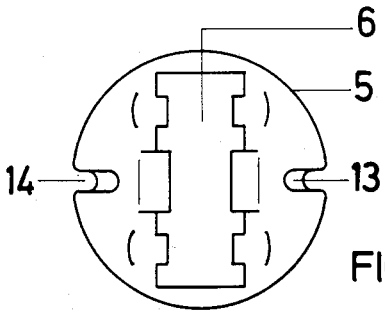
FIG. 2 is a top plan view of the metal cap.

A halogen cycle incandescent lamp has a lamp bulb 1 made of refractory glass and a tungsten filament 2, which serves as the luminous element. The bulb 1 is filled with an inert gas with a halogen additive. The bulb 1 is closed off at its lower end by a press seal stem 4. A lead-in wire 3 passes through the press stem 4, from one side of filament 2, to the region exterior to the bulb 1. A metal sleeve 5 grips the press stem 4, which is seated in an opening 6 in the metal sleeve 5, by means of inwardly bent flaps 7. The bent flaps 7 press elastically against projections 8 of the press seal stem (FIG. 3). The metal sleeve 5 is cylindrical. The metallic base shell structure 10 of lamp base 9 is also cylindrical and has a diameter slightly larger than that of metal sleeve 5, which it receives with a predetermined clearance. In the bottom of the lamp base shell 10 is an insulator 11, through which the lead-in wire 3 passes to form a center bottom contact 12. The base shell 10 serves as the side contact. A second lead-in wire 3*a* has one of its ends passed between, and in electrical contact with, metal sleeve 5 and the base shell 10.

In accordance with a feature of the invention, the metal sleeve 5 is formed with an inwardly depressed groove 13. The end 3*a* of the wire is placed in a groove 13 of the metal sleeve 5, while the remaining portion of the wire 3 passes through press stem 4 to contact the second side of filament 2. The groove 13 extends in a direction generally parallel to the axis of the metal base structure. In this manner, the lead-in wire end 3*a* establishes good electric contact with the metal base shell, without causing any obstructions or bulges on the outer surface of the base shell. This permits the use of the outer surface of the shell, which also acts as a side contact, for focusing or position adjustment of the lamp.

A second groove 14 on the outer rim of metal sleeve 5 is positioned diametrically opposite groove 13. After the focusing and positioning adjustment of the lamp in the base shell structure, the sleeve 5 and side contact are soldered to the base shell 10 by means of a solder ring 16, utilizing and filling a predetermined clearance zone between the metal sleeve 5 and the base shell 10.

The groove 13 in the metal sleeve is dimensioned in size to permit the end section of lead-in wire 3*a* to fit snugly into the groove.

I claim:

1. An electric lamp comprising a lamp bulb (1) made of refractory glass material;

a lamp press (4) formed at the bottom of the lamp bulb and having locating projections (8);

a filament (2) mounted in the lamp bulb (1) and acting as the luminous element of the lamp;

two lead-in wires (3) which contact the filament (2) in the lamp bulb (1) and pass through the lamp press (4) to the exterior of the bulb;

a metal sleeve (5) of cylindrical shape, provided with an opening (6) in which the lamp press (4) is inserted, said sleeve having inwardly bent flaps (7) which grip and position the lamp press (4) by pressing with an elastic force against the projections (8) of the lamp press;

a metal base shell (10) of cylindrical shape, having a diameter slightly larger than that of the metal sleeve (5) receiving said metal sleeve (5);

a bottom contact (12) secured to the base shell (10) and insulated therefrom;

wherein:

a first lead-in wire is carried to the bottom contact (12) of the base shell to provide one connection terminal for the filament;

the metal sleeve (5) is formed with an inwardly extending groove (13) located at the outer rim thereof, an end portion (3*a*) of a second lead-in wire being placed in said groove (13) to establish electrical contact of the second lead-in wire with the metal base shell (10) inwardly thereof, and without causing an obstruction or bulging of the exterior surface of the base shell (10); and wherein a solder connection (16) is provided between the metal sleeve (5) and the base shell (10) to reliably and securely position the filament within the bulb with respect to the base shell, the solder connection also soldering the second lead-in wire located in the groove (13) to the base shell inwardly thereof.

2. An electric lamp according to claim 1, wherein the lead-in wire (3*a*) and the groove (13) are matched in size and shape such that the wire fits essentially snugly into the groove.

3. An electric lamp according to claim 1, wherein the bulb comprises a fill including halogen, and the lamp is a halogen incandescent lamp.

4. An electric lamp according to claim 2, wherein the bulb comprises a fill including halogen, and the lamp is a halogen incandescent lamp.

5. An electric lamp according to claim 1, wherein the solder connection comprises a re-melted solder ring (16).

6. An electric lamp according to claim 5, wherein the lead-in wire (3*a*) and the groove (13) are matched in size and shape such that the wire fits essentially snugly into the groove.

7. An electric lamp according to claim 5, wherein the bulb comprises a fill including halogen, and the lamp is a halogen incandescent lamp.

8. An electric lamp according to claim 6, wherein the bulb comprises a fill including halogen, and the lamp is a halogen incandescent lamp.

9. An electric lamp according to claim 1, wherein said inwardly extending groove (13) extends essentially axially with respect to the base shell (10).

10. An electric lamp according to claim 2, wherein said inwardly extending groove (13) extends essentially axially with respect to the base shell (10).

11. An electric lamp according to claim 4, wherein said inwardly extending groove (13) extends essentially axially with respect to the base shell (10).

12. An electric lamp according to claim 5, wherein said inwardly extending groove (13) extends essentially axially with respect to the base shell (10).

13. An electric lamp according to claim 6, wherein said inwardly extending groove (13) extends essentially axially with respect to the base shell (10).

14. An electric lamp according to claim 7, wherein said inwardly extending groove (13) extends essentially axially with respect to the base shell (10).

* * * * *